US007431553B2

(12) United States Patent
Nishi et al.

(10) Patent No.: US 7,431,553 B2
(45) Date of Patent: Oct. 7, 2008

(54) LOADER WORK MACHINE

(75) Inventors: Ryoichi Nishi, Kawachinagano (JP); Shusaku Yamaguchi, Osaka (JP); Arinobu Ishida, Sakai (JP); Kosuke Oyama, Sakai (JP)

(73) Assignee: Kubota Corporation, Osaka (JP)

( * ) Notice: Subject to any disclaimer, the term of this patent is extended or adjusted under 35 U.S.C. 154(b) by 95 days.

(21) Appl. No.: 11/230,315

(22) Filed: Sep. 19, 2005

(65) Prior Publication Data

US 2006/0245900 A1 Nov. 2, 2006

(30) Foreign Application Priority Data

Mar. 15, 2005 (JP) ..... 2005-073970

(51) Int. Cl.
*B66C 23/00* (2006.01)

(52) U.S. Cl. ..... 414/686; 172/274

(58) Field of Classification Search ..... 414/686; 172/272–275

See application file for complete search history.

(56) References Cited

U.S. PATENT DOCUMENTS 6,142,724 A * 11/2000 Hirooka et al. ..... 414/686
6,386,821 B1 * 5/2002 Schneider ..... 414/686
6,986,634 B2 * 1/2006 Westendorf et al. ..... 414/686
2003/0223851 A1 * 12/2003 Muramoto ..... 414/686
2004/0265109 A1 * 12/2004 Uchijima et al. ..... 414/686

FOREIGN PATENT DOCUMENTS

JP 2000-309940 7/2000
JP 2001-132006 5/2001

* cited by examiner

*Primary Examiner*—Donald Underwood
(74) *Attorney, Agent, or Firm*—The Webb Law Firm

(57) ABSTRACT

A loader work machine including a vehicle body, and a working implement having booms and boom cylinders and mounting frame units for attaching the working implement to a front portion of the vehicle body. Each of the mounting frame units includes a mounting plate fixed to the vehicle body, a support base projecting laterally outward from the mounting plate, a main frame erected on the support base, and a side frame for pivotally supporting proximal ends of one of the booms and one of the boom cylinders. The side frame includes right and left side plates and a connecting element for interconnecting the right and left side plates. The side frame is detachably attached to the main frame by engaging an engaging member disposed in a lower portion of the side frame with an engageable member of the main frame, and connecting a connecting member formed on the side frame to a connectable member formed on the main frame. The main frame is formed as a one-piece plate insertable between the right and left side plates.

6 Claims, 5 Drawing Sheets

LOADER WORK MACHINE

BACKGROUND OF THE INVENTION

1. Field of the Invention

This invention relates to a loader work machine having a working implement such as a front loader attached to a front portion of a vehicle body such as a tractor.

2. Description of the Related Art

In some conventional loader work machines, side frames disposed on opposed lateral sides of the vehicle body for supporting booms are detachably attached to respective mounting frames on the lateral sides by fitting engaging pins into respective recesses of receiving members and inserting mounting pins through respective bosses on the lateral sides. In such a conventional loader work machine, each of the mounting frames includes a mounting plate to the vehicle body, a support base projecting laterally outwardly from the mounting plate and a main frame fixed to a laterally outward end of the support base. Each main frame is formed to have a box shape by welding a plurality of metal plate members (see JP-A-2001-132006 and JP-A-2000-309940, for example).

The above conventional loader work machine has room for improvement with regard to low productivity, since each main frame is formed of many welded parts with large weld lengths, and to difficulty in securing dimensional accuracy owing to welding distortions.

SUMMARY OF THE INVENTION

Having regard to the prior art noted above, the object of the invention is to decrease the number of welded parts and weld lengths, thereby improving productivity and easily securing required dimensional accuracy.

The above object is fulfilled, according to this invention, by a loader work machine comprising:

a vehicle body;

a working implement having booms and boom cylinders; and mounting frame units for attaching said working implement to a front portion of said vehicle body, each of said mounting frame units including:

a mounting plate fixed to said vehicle body;

a support base projecting laterally outward from said mounting plate;

a main frame erected on said support base; and a side frame for pivotally supporting proximal ends of one of said booms and one of said boom cylinders, said side frame including right and left side plates and a connecting member for interconnecting said right and left side plates, said side frame being detachably attached to said main frame by engaging an engaging member disposed in a lower portion of said side frame with an engageable member of said main frame, and connecting a connecting member formed on said side frame to a connectable member formed on said main frame;

wherein said main frame is formed as a one-piece plate insertable between said right and left side plates.

By forming the main frame as a one-piece plate, the number of welded parts and the weld lengths may be decreased, thereby achieving improved productivity and reduced cost, and securing required dimensional accuracy with ease.

Preferably, the engaging member is a pin with an axis extending in a right and left direction, and the engageable member may include a recess for receiving the pin, and an inclined surface for guiding the pin into the recess. The connecting member and the connectable member are bosses with pin holes, respectively, and the side frame is attached to the main frame by inserting a pin through the pin holes. The engageable member and the connectable member project from the surfaces of the one-piece plate main frame toward the right and left side plates of the side frame.

In one preferred embodiment of the invention, said support base is formed cylindrical, said main frame has a mounting bore fitted and welded to said support base, said mounting bore, said engageable member and said connectable member being formed of cast steel to be integral with said main frame. With this construction, the same main frame and/or support base may be used on both right and left sides of the vehicle body, which contributes a further cost reduction.

In another preferred embodiment, said mounting plate extends forwardly of said vehicle body from a mounting position on said support base, and is bent transversely inwardly at an intermediate position thereof. This construction increases a steering angle of each front wheel.

Other features and advantages of the invention will be apparent reading from the following description with reference to the accompanying drawings.

DESCRIPTION OF THE PREFERRED EMBODIMENTS

A preferred embodiment of the invention will be described hereinafter with reference to the drawings.

In the following description, the terms "fore and aft direction" and "right and left direction" are defined as forward, rearward, rightward and leftward directions with reference to an advancing direction of a working vehicle, and "vertical direction" is vertical with respect to a vehicle body.

Figure 1:
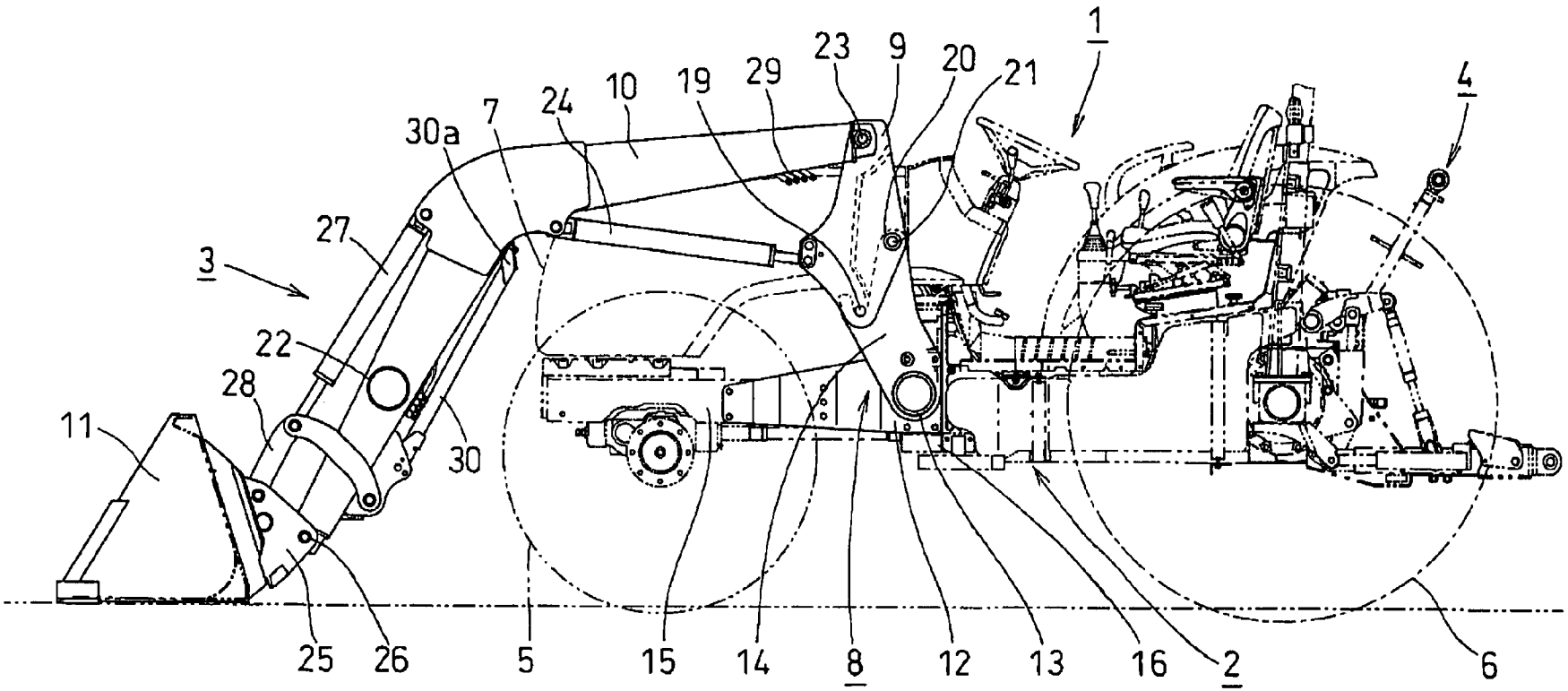
FIG. 1 is an entire side elevation of a loader work machine according to one embodiment of this invention.

FIG. 1 shows a tractor-mounted loader work machine 1 as one example of a working vehicle (load handling vehicle). The loader work machine 1 includes a tractor (vehicle body) 2 having a front loader (working implement) 3 attached to a front portion thereof, and a three-point link mechanism 4 attached to a rear portion thereof for connecting a further, rear working implement such as a cultivator.

The tractor 2 is of a two-axle and four-wheel type with a pair of right and left front wheels 5 and a pair of right and left rear wheels 6, and has a hood 7 disposed at the front portion thereof for covering an engine, a radiator and a battery, etc.

The front loader 3 includes side frames 9 detachably attached to mounting frames 8 disposed on the right and left sides of the tractor 2, booms 10 having proximal ends thereof pivotably connected to the side frames 9, and a bucket 11 acting as a working device attached to distal ends of the right and left booms 10.

Figure 2:
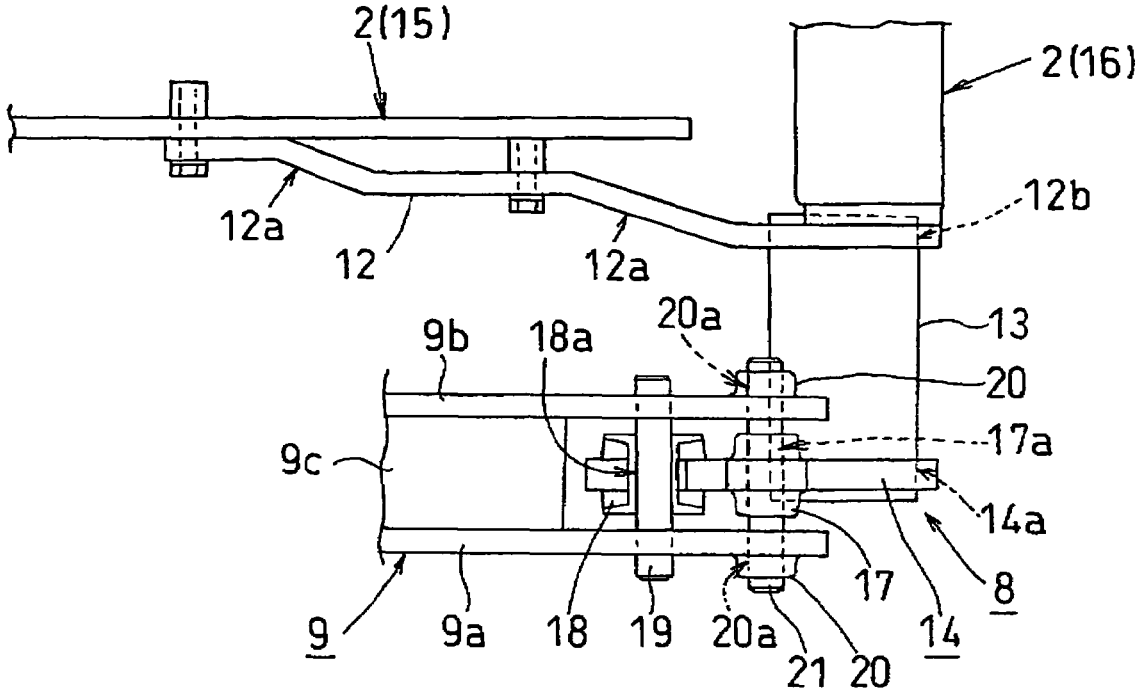
FIG. 2 is an enlarged plan view showing a principal portion of a construction for mounting a side frame to a main frame in the loader work machine.

As shown in FIGS. 1 and 2, each of the right and left mounting frames 8 includes a mounting plate 12 attached to a lower front portion of the tractor 2 (a lower position adjacent to a rear end of the hood 7), a support base 13 projecting laterally outward from the mounting plate 12, and a main frame 14 projecting upward from the support base 13.

The mounting plate 12 extends forwardly of the vehicle body 2 from the support base 13, has a front end thereof attached to an outer lateral surface of a front axle frame 15 of the vehicle body 2, and has a rear end thereof attached to an outer lateral surface of a flywheel housing 16 disposed adjacent to a rear end of the engine. The front axle frame 15 of the vehicle body 2 has a smaller width in a transverse direction (right and left direction) of the vehicle than the flywheel housing 16, to allow for as large a steering angle of the front wheels as possible. For this purpose, each mounting plate 12 has a bent portion 12*a* bent at an intermediate position thereof transversely inwardly so that the front end attachment position is located more transversely inward than the rear end attachment position. An entire mounting plate 12 is formed of a one-piece steel plate.

Each of the support bases 13 is formed in a cylindrical shape using a steel pipe material or the like, with one end thereof fitted in and welded to a mounting bore 12*b* in the rear end portion of the mounting plate 12 to be integral therewith, and the other end thereof fitted in and welded to a mounting bore 14*a* in the lower end portion of the main frame 14 to be integral therewith.

A rear end mounting portion 12*c* of the mounting plate 12 is bolted to the flywheel housing 16, at four, upper and lower, and rear and front points. The lower front and lower rear bolt bores 12*d* and 12*e* are in positions downwardly projecting from a lower end of the main frame 14, and are exposed in a lateral side view to allow for bolting and unbolting operations to be carried out from the side. However, the upper front and rear bolt bores 12*f* and 12*g* in the mounting portion 12*c* are hidden behind the main frame 14 in the lateral side view, thereby obstructing access to the bolt bore 12*f* for bolting or unbolting work from the side. In order to solve this problem, a bore 14*b* for inserting a screwdriver is formed in the main frame 14 in a position aligned with the upper front bolt bore 12*f*. For the upper rear bolt bore 12*g* of the mounting plate 12, no insertion bore for screwdriver is formed in the main frame since the overlapping main frame 14 does not obstruct bolting and unbolting work. However, a further bore for inserting a screwdriver for the bolt bore 12*g* may be formed in the main frame 14 in the same fashion as for the bolt bore 12*f*.

Figure 5:
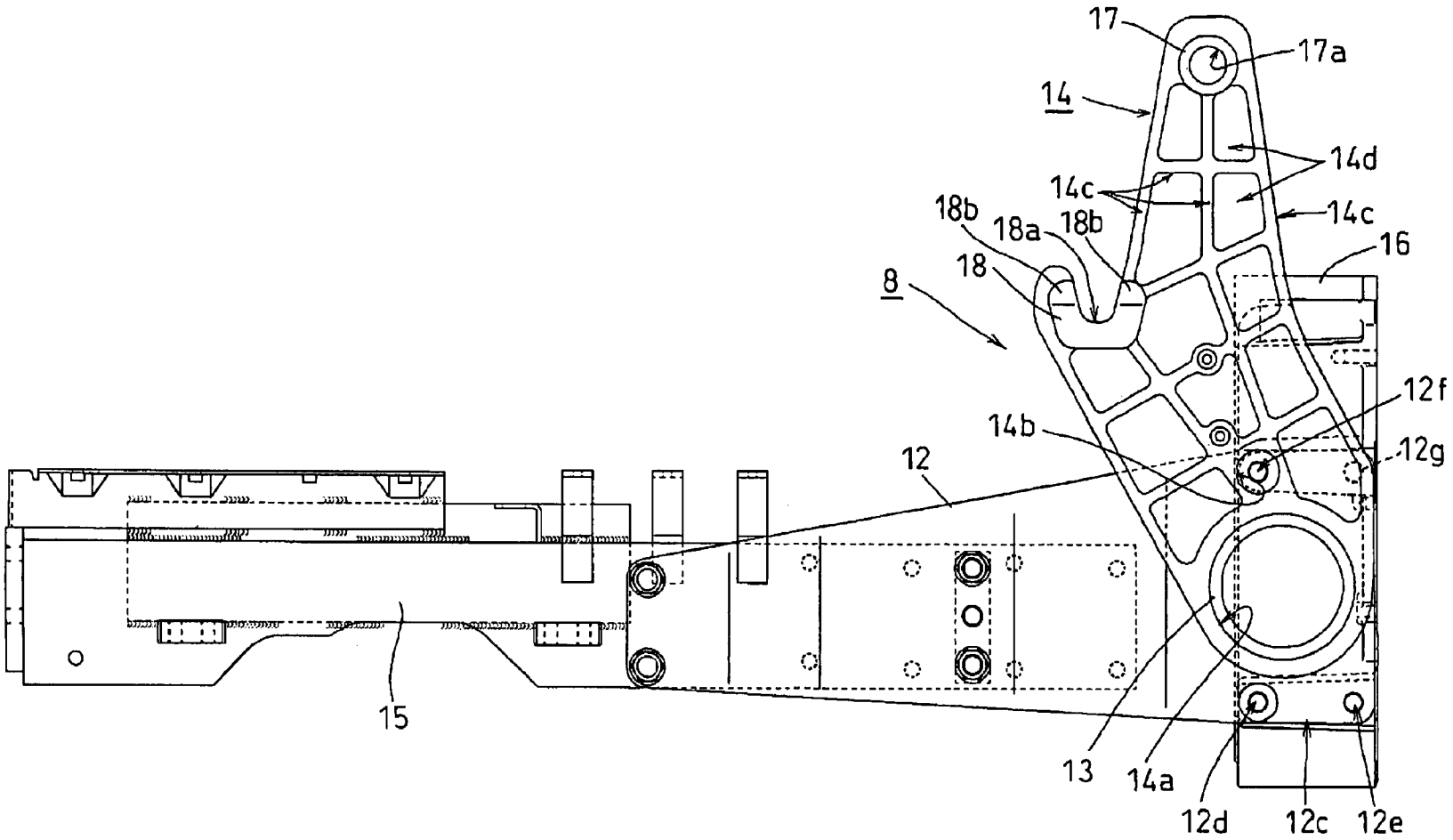
FIG. 5 is a side view of FIG. 4.

As shown in FIGS. 2 through 5, the main frame 14 has a cylindrical boss 17 formed integral with the upper portion thereof and having a pin hole 17*a* having its axis extending in a right and left direction. The main frame 14 has a receiving member 18 formed integral with a vertical intermediate forward portion thereof and defining an upwardly open arcuate receiving recess 18*a*. The main frame 14 is made of cast steel to be a one-piece plate (thick plate). As shown in FIG. 5, an appropriate number of reinforcing ribs 14*c* are formed crisscross in the vertical and fore and aft directions on both surfaces (or one surface) of the main frame 14, with recesses 14*d* formed between adjacent reinforcing ribs 14*c* to achieve a weight reduction.

The main frames 14 are mounted on both sides of the front portion of the vehicle body 2 via the support bases 13 and mounting frames 12 in order to removably connect the side frames 9 of the front loader 3 to the front portion of the vehicle body 2.

The side frames 9 are disposed at the rear ends of the right and left booms 10 of the front loader 3 to removably connect the front loader 3 to the front portion of the vehicle 2 by using the main frames 14.

Figure 3:
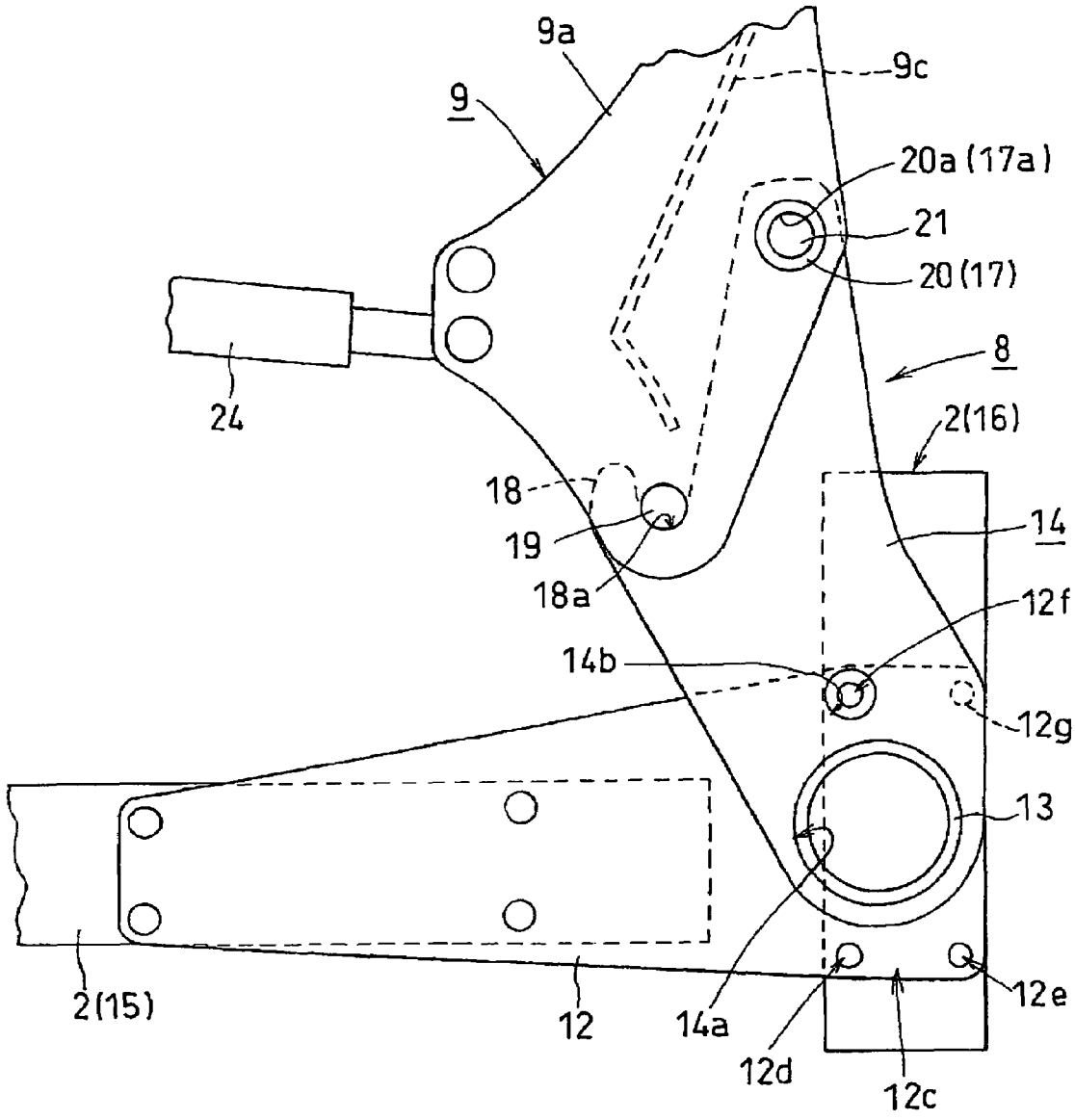
FIG. 3 is a side view of FIG. 2.
Figure 4:
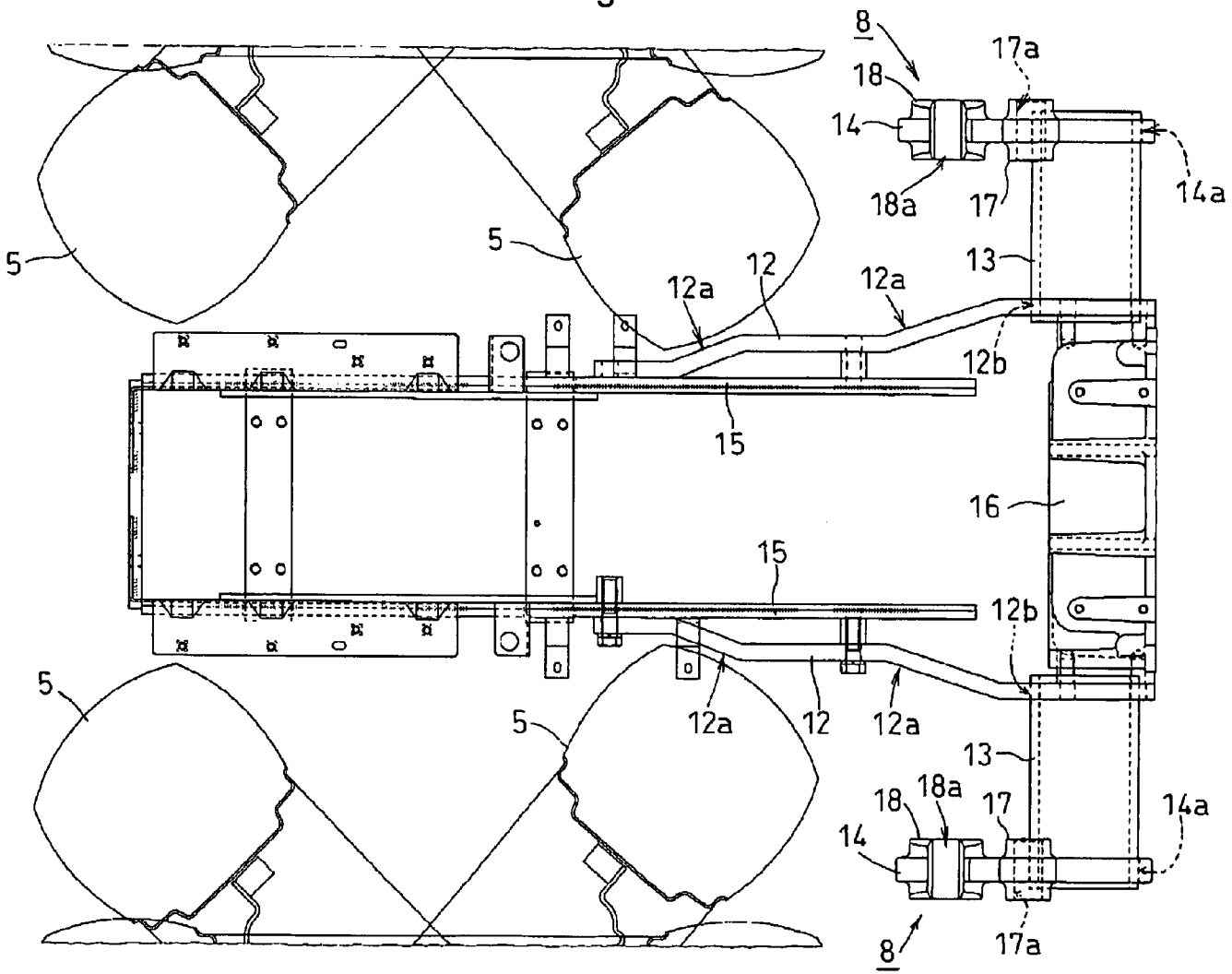
FIG. 4 is a plan view showing a construction for mounting the main frame in FIG. 2 to a vehicle body.

As shown in FIGS. 2 and 3, each of the side frames 9 includes right and left side plates 9*a* and 9*b*, and a connecting element 9*c* for interconnecting the side plates 9*a* and 9*b*. Each side frame 9 further includes an engaging member (engaging pin) 19, with an axis extending in the right and left direction, fixed to the lower front end portion thereof and extending between the right and left side plates 9*a*, 9*b*. Bosses 20, each having a pin hole 20*a* formed therein, are disposed in a vertically intermediate rear portion of the side frame 9. As shown in FIG. 2, the bosses 20 protrude from outer surfaces of the right and left side plates 9*a* and 9*b* of the side frame 9. As shown in FIG. 2, the boss 17 and receiving member 18 of each main frame 14 protrude from the surfaces of the main frame 14 formed as one-piece plate, toward the right and left side plates 9*a* and 9*b* of the side frame 9. These allows a smooth mounting/dismounting of the side frame 9 to/from the main frame 14, and reduces play in the right and left direction at the same time. As shown in FIG. 5, the receiving member 18 of the main frame 14 is constructed such that upper portions of right and left surfaces of the receiving recess 18*a* become gradually narrower from bottom to top, thus forming inclined guide surfaces 18*b* of pointed shape. When the side frame 9 is connected with the main frame 14, the inclined guide surfaces 18*b* allow the engaging member (engaging pin) 19 to be smoothly engaged in the receiving recess 18*a* of the receiving member 18.

The relationship between the side frame 9 and the main frame 14 is as follows. By fitting the engaging member (engaging pin) 19 of the side frame 9 in the receiving recess 18*a* of the receiving member 18 of the main frame 14 from above, the side frame 9 is engaged with the main frame 14 to be rockable back and forth about the transverse axis (engaging pin) 19, and by rocking the side frame 9 about the transverse axis for adjustment, the pin hole 17*a* of the boss 17 of the main frame 14 is aligned to the pin hole 20*a* of the boss 20 of the side frame 9. A mounting pin 21 is inserted through these aligned pin holes 17*a* and 20*a* to removably attach the side frame 9 to the main frame 14.

The pin hole 20*a* of the boss 20 of the side frame 9 and the pin hole 17*a* of the boss 17 of the main frame 14 are all formed in shape of circular holes having the same diameter.

The front loader 3 is provided with the pair of right and left booms 10 arranged at the right side and left side of the hood 7. The right and left booms 10 have front portions connected to each other by a cylindrical boom connector 22 (FIG. 1).

Each of the right and left booms 10 has a proximal end (rear end) pivotally connected by a pivot 23 to the upper portion of corresponding side frame 9 to be rockable up and down about a transverse axis.

A boom cylinder 24 in the form of a double-acting hydraulic cylinder extends between a longitudinally intermediate position each of the right and left booms 10 and a vertically intermediate position each of the right and left side frames 9. The right and left booms 10 may be vertically rocked by extending and contracting the right and left boom cylinders 24.

The bucket 11 has a pair of right and left brackets 25 arranged in lower position on the rear surface thereof. Distal ends of the right and left booms 10 are pivotally connected through a pivot 26 to the right and left brackets 25, respectively. A bucket cylinder 27 in the form of a double-acting hydraulic cylinder is attached to the rear surface of the bucket 11 through links 28 and to an upper surface of a longitudinally intermediate position of the booms 10. The bucket 11 may be rocked (for scooping and dumping action) by extending and contracting the bucket cylinder 27.

As shown in FIG. 2, each of the right and left booms 10 is bent in a longitudinally middle portion thereof forming an upwardly protruding or arched shape, with a vertical width gradually increasing from both front and rear ends toward the longitudinally middle position. The boom 10 presents a substantially angular cylindrical shape as a whole.

The boom 10 has hydraulic pipes 29 extending along a longitudinal recess defined in the undersurface thereof and connected to the boom cylinder 24 and bucket cylinder 27.

The rear end of each hydraulic pipe 29 is connected to a control valve (not shown) on the main frame 14 through a hydraulic hose.

The front loader 3 has a stand 30 for supporting the booms 10 with the bucket 11 resting on the ground when the front loader 3 is detached from the tractor 2.

To detach the front loader 3 from the tractor 2, for example, the forward portion at the bottom of the bucket 11 is first placed in contact with the ground, and the stand 30 is lowered from a non-use position to a use position. Then, the mounting pins 21 are drawn out of the pin holes 20*a* of the side frames 9 and the pin holes 17*a* of the main frames 14.

Next, the bucket cylinder 27 is contracted to lower the booms 10 to have a ground-engaging member 30*a* of the stand 30 contact the ground, and then the booms 10 are rocked about the ground-engaging member 30*a* of the stand 30 to raise the side frames 9. Then the engaging pins 19 of the side frames 9 disengage upward from the recesses 18*a* of the receiving members 18. The front loader 3 now assumes a standing position with the booms 10 supported by the stand 30 and the bottom of the bucket 11 in contact with the ground.

Thereafter, the hydraulic hoses connected to the control valves are disconnected from the hydraulic pipes 29 arranged on the front loader 3, and the tractor 2 is driven backward.

The front loader 3 is attached to the tractor 2, by an operation reversed from the above procedure. In this case, the side frames 9 are lowered in a forwardly tilted posture to fit the engaging pins 19 of side frames 9 from above into the receiving recesses 18*a* of the receiving members 18 of the main frames 14. As a result, the side frames 9 are engaged with the main frames 14 to be rockable back and forth about the transverse axis (engaging pins 19). Then, the side frames 9 are adjusted by rocking backward about the transverse axis relative to the main frames 14 to align the pin holes 17*a* of the main frames 14 to the pin holes 20*a* of the side frames 9, and the mounting pins 21 are inserted through these pin holes to fix the side frames 9 to the main frames 14.

Each main frame 14 according to this invention is simplified by its one-piece plate construction presenting an improved outward appearance. By integrally forming each main frame 14 of cast steel, the number of welded parts is reduced, and so are weld lengths, to improve productivity and to secure required dimensional accuracy with ease.

Each mounting frame 8 according to this invention is constructed of three separate parts, i.e. the mounting plate 12, support base 13 and main frame 14. The support base 13 is formed cylindrical, and the mounting bores 12*b* and 14*a* are respectively formed in the mounting plate 12 and main frame 14 for fitting both ends of the support base 13 therein, and the fitted portions are subsequently welded. Therefore, the support base 13 and main frame 14 may be used either the right side or left side of the vehicle body 2 depending on which end of the support base 13 the main frame 14 is welded to.

The mounting plate 12 of each mounting frame 8 for connecting to the vehicle body 2, according to this invention, extends forwardly of the vehicle body 2 from the mounting position (rear end mounting position) on the side of the flywheel housing 16, which has a large transverse dimension, to the mounting position (front end mounting position) on the side of the front axle frame 15, which has a small transverse dimension. The mounting plate 12 is bent, in a halfway position, transversely inwardly to place the front end mounting position to be more transversely inward than the rear end mounting position. Thus, the front end of the mounting plate is attached tight to the side of the front axle frame 15. This prevents interference between the front ends of the mounting plates 12 and the front wheels 5, and allows an increase in the steering angle of the front wheels 5.

In the embodiment shown in the drawings, the engaging pins 19 are disposed on the side frames 9 and the receiving members 18 are disposed on the main frames 14. However, this arrangement may be reversed. The main frames 14 may also be formed by cutting a steel plate to the same contour as in the described embodiment, with separately made bosses 17 and receiving members 18 welded to and protruding from both sides of each steel plate.

As described above, the one-piece plate structure of the main frames according to this invention realizes improved productivity by decreasing the number of welded parts as well as the length of welds, cuts down cost and easily obtains required dimensional accuracy.

What is claimed is:

1. A loader work machine comprising:

a vehicle body;

a working implement having booms and boom cylinders; and mounting frame units for attaching said working implement to a front portion of said vehicle body, each of said mounting frame units including:

a mounting plate fixed to said vehicle body;

a support base projecting laterally outward from said mounting plate;

a side frame for pivotally supporting proximal ends of one of said booms and one of said boom cylinders, said side frame including right and left side plates and a connecting member for interconnecting said right and left side plates, said right and left side plates having a first pin extending therebetween, and each of said right and left side plates having a first hole defined therein; and a main frame for detachably connecting and supporting said side frame, said main frame being formed as a one-piece plate insertible between said right and left side plates, said main frame defining a receiving member recessed and opened to be engageable with said first pin, said main frame further defining a second hole alignable with the first hole of each of said right and left side plates; wherein a first boss is provided along said receiving member and a second boss is provided around said second hole, said first and second bosses protruding larger than a right/left width of said one-piece plate of the main frame toward said right and left side plates of the side frame to assist connection of said main frame to said side frame;

said main frame is directly connected with and supported by said support base to stand erect from said support base; and said main frame formed as a one-piece plate has, on at least one of a right side and a left side thereof, a first vertical rib extending from said first boss to said support base and a second vertical rib extending from said second boss to said support base, said first and second vertical ribs protruding laterally from the at least one side of said main frame formed as a one-piece plate.

2. The loader work machine as defined in claim 1, wherein the main frame further has a plurality of vertical ribs and fore-and-aft ribs defined on the at least one side thereof, a plurality of recesses being provided in spaces defined by the vertical and fore-and-aft ribs and opened laterally of the one-piece main frame.

3. The loader work machine as defined in claim 1, wherein the recessed receiving member opens upward, and the main frame has said first boss of the receiving member and said second boss defined at front and upper positions thereof, respectively; and wherein engaging said first pin with said receiving member and pivoting said side frame relative to said main frame about said engaged first pin aligns said first hole with said second hole; and inserting a second pin through said aligned first and second holes detachably mounts a lower portion of said side frame on said main frame.

4. The loader work machine as defined in claim 1, wherein said support base is formed in a cylindrical shape, said main frame has a mounting bore fitted and welded to said support base, and wherein said mounting bore and said bosses of said main frame are formed of cast steel to be integral with one another.

5. The loader work machine as defined in claim 1, wherein said mounting plate extends forwardly of said vehicle body from a mounting position on said support base, and is bent transversely inwardly at an intermediate position thereof.

6. A loader work machine comprising:

a vehicle body;

a working implement having booms and boom cylinders; and mounting frame units for attaching said working implement to a front portion of said vehicle body, each of said mounting frame units including:

a mounting plate fixed to said vehicle body;

a support base projecting laterally outward from said mounting plate;

a side frame for pivotally supporting proximal ends of one of said booms and one of said boom cylinders, said side frame including right and left side plates and a connecting member for interconnecting said right and left side plates, said right and left side plates having a first pin extending therebetween, and each of said right and left side plates having a first hole defined therein; and a main frame for detachably connecting and supporting said side frame, said main frame being formed as a one-piece plate insertible between said right and left side plates, said main frame defining at a forward position thereof, a receiving member engageable with said first pin, said main frame defining at an upper position thereof a second hole alignable with the first hole of each of the right and left side plates, wherein engaging said first pin with said receiving member and pivoting said side frame relative to said main frame about said engaged first pin aligns each of said first holes with said second hole, and inserting a second pin through said aligned first and second holes detachably mounts a lower portion of said side frame on said main frame;

a first boss protruding, from said receiving member, larger than a right/left width of said main frame formed as a one-piece plate toward said right and left side plates of the side frame to assist connection of said main frame to said side frame; and a second boss protruding, from said second hole, larger than the right/left width of said main frame toward said right and left side plates of the side frame to assist connection of said main frame to said side frame;

wherein said main frame is directly connected with and supported by said support base to stand erect from said support base; and said main frame has, on at least one of right/left sides thereof, a plurality of vertical ribs, a plurality of fore-and-aft ribs and a plurality of recesses provided in spaces defined by the vertical and fore-and-aft ribs and opened laterally of the main frame, said vertical ribs including a first vertical rib extending from said first boss to said support base and a second vertical rib extending from said second boss to said support base.

* * * * *